US006267068B1

(12) United States Patent
Fickers et al.

(10) Patent No.: US 6,267,068 B1
(45) Date of Patent: Jul. 31, 2001

(54) REINFORCED STITCHED SEAM FOR HIGH-TENSILE WOVEN FABRICS

(75) Inventors: Gisela Fickers; Stephanie Kuckart, both of Eupen (BE)

(73) Assignee: AstenJohnson, Inc., Charleston, SC (US)

( * ) Notice: Subject to any disclaimer, the term of this patent is extended or adjusted under 35 U.S.C. 154(b) by 0 days.

(21) Appl. No.: 09/142,943

(22) PCT Filed: Mar. 15, 1997

(86) PCT No.: PCT/EP97/01346

§ 371 Date: Nov. 26, 1999

§ 102(e) Date: Nov. 26, 1999

(87) PCT Pub. No.: WO97/35064

PCT Pub. Date: Sep. 25, 1997

(Under 37 CFR 1.47)

(30) Foreign Application Priority Data

Mar. 19, 1996 (DE) ..... 196 10 696

(51) Int. Cl.[7] ..... D05B 1/18; D21F 1/16
(52) U.S. Cl. ..... 112/440; 162/904
(58) Field of Search ..... 112/440, 402, 112/406, 415, 441; 162/348, 357, 382, 900, 901, 902, 903, 904

(56) References Cited

U.S. PATENT DOCUMENTS

| | | | | |
|---|---|---|---|---|
| 3,998,173 | * | 12/1976 | Williamson et al. | 112/440 |
| 4,141,388 | | 2/1979 | Romanski et al. | 139/383 A |
| 5,746,257 | * | 5/1998 | Fry | 162/348 X |
| 5,875,822 | * | 3/1999 | Fargeout | 162/904 |
| 6,065,505 | * | 5/2000 | Fickers | 162/904 |

FOREIGN PATENT DOCUMENTS

| | | |
|---|---|---|
| 324110 | 8/1975 | (AT) . |
| 2449792 | 2/1976 | (DE) . |
| 2806742 | 9/1978 | (DE) . |
| 813486 | 6/1937 | (FR) . |

* cited by examiner

*Primary Examiner*—Ismael Izaguirre
(74) *Attorney, Agent, or Firm*—Volpe and Koenig, P.C.

(57) ABSTRACT

The invention concerns a stitched seam for high-tensile woven fabric sections, in particular dryer screen fabric for paper machine clothing, wherein the warp yarn loops (6) located at the end of the two woven fabric sections (1, 2) to be interconnected are interconnected at the common seam line by a closure wire (9). Associated with the warp yarn loops (6) at the location of the stitched seam and with the closure wire (9) is at least one reinforcing yarn (8) which takes up loops disposed parallel to the warp yarn loops in the eyelet region in order to take up the closure wire.

11 Claims, 4 Drawing Sheets

Figure 1:
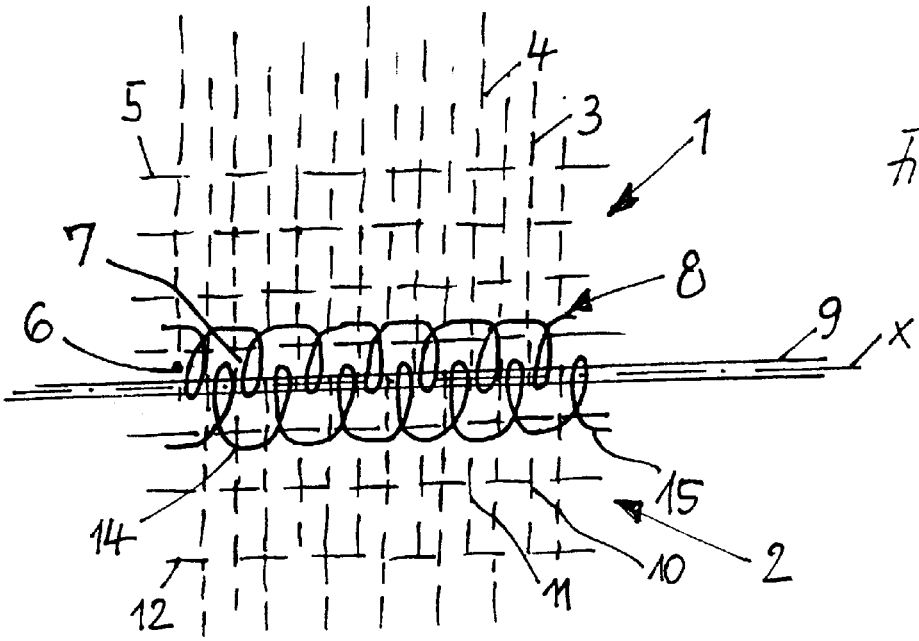

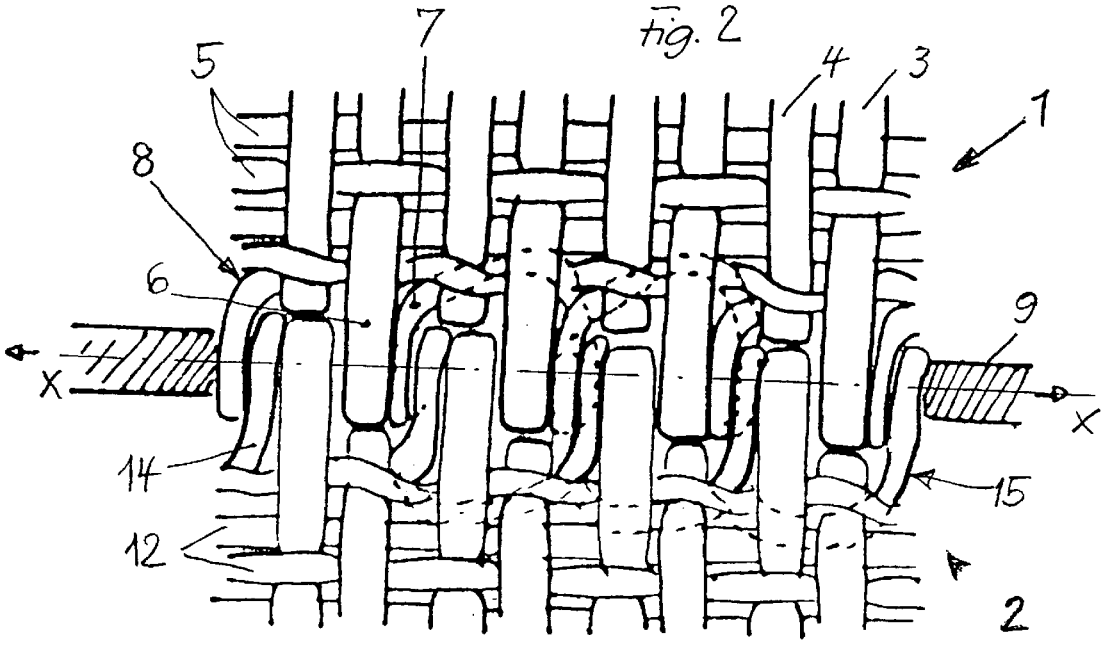
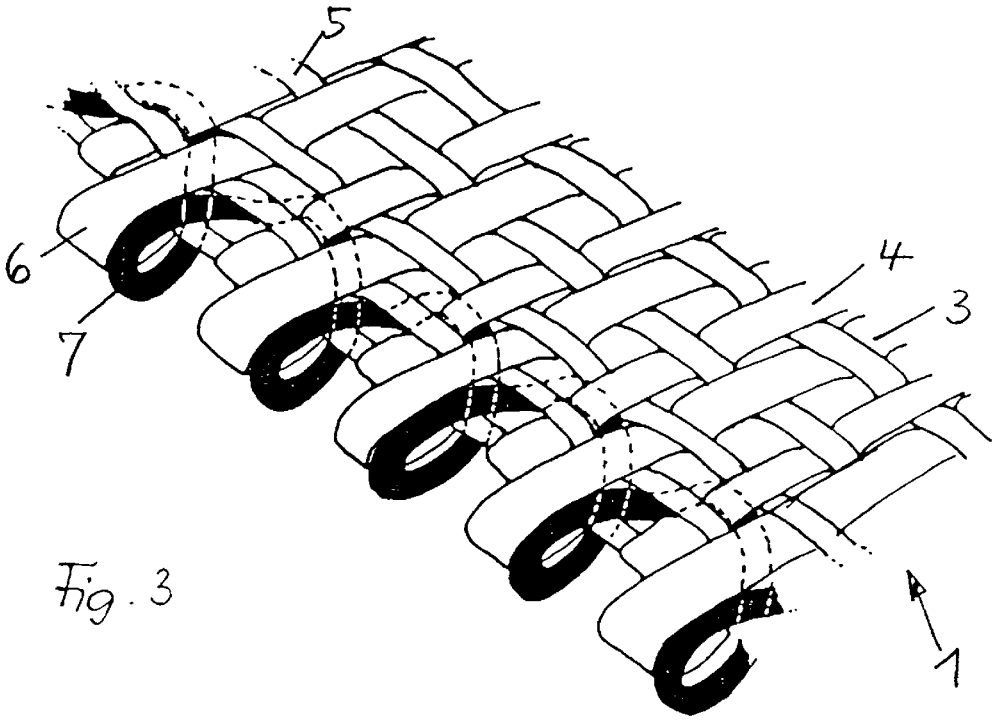
Fig. 3

REINFORCED STITCHED SEAM FOR HIGH-TENSILE WOVEN FABRICS

The object of the invention is to provide, for fabrics of the subject type, a reinforcement of the stitched seam having very high seam tear strength.

This is accomplished by adding to the warp yarn loops at the stitched seam location and the closure wire at least one reinforcing yarn which has loops in the vicinity of the eyelets extending parallel to the warp yarn loops for receiving the closure wire.

Further embodiments of the invention are the subject of the dependent claims.

Through the configuration of a stitched fabric seam in accordance with the invention the seam tear strength is decisively increased, due to the additional connecting yarn or wire which is enmeshed in the eyelet region either loosely or as a helical yarn. This yarn or wire can consist of various materials, preferably of monofilaments with round or flat cross-section, e.g. polyester, PEEK, Ryton, polyamide, PCTA, metal or the like, or of mono- and multiplastics with various core yarns. All yarns can be braided or spun, impregnated, coated, including the use of carbon filaments or fibers. Further inserts of thin steel wires can be used. Reinforcing yarns of the inventive kind preferaly have a thickness which is equal to or smaller than the thickness of the seam loops. They are, for example, anchored in each case behind one or more cross machine direction (CMD) yarns.

In a specific embodiment of the invention the seam reinforcement is so configured around the closure wire that one warp yarn loop of the warp yarn from one of the fabric portions and one loop of the helical reinforcing yarn at one side of the seam connection alternates with one turn of the helical reinforcing strip and a warp loop of the warp yarn from the confronting fabric portion.

In another specific embodiment of the invention, the reinforced seam connection is so constructed that, along the length-wise axis of the closure wire, one warp loop of the warp yarn from one of the fabric portions alternates with one turn of the reinforcing helix of this fabric portion with a warp loop of a warp yarn from the other fabric portion and a turn of the reinforcing strip from of the other fabric portion, and so forth.

Basically, by means of the invention, there is bound in the eyelet region of the warp yarns adjoining both sides of the stitched seam an additional yarn either loosely or as a separate helix. This provides a high tensile stitched seam which substantially enhances the seam tear strength. That is especially desirable for fabrics with low warp yarn count, because a hinge effect which that causes has a negative influence on the tear strength. Because of the increased seam tear strength, there exist other possibilities for applying various combinations of materials in eyelet region to better meet the higher requirements in paper making machinery technology. Because such reinforcing yarns reduce the spacing between the eyelets of any two adjoining warp yarns, the hinge effect which adversely affects or damages the seam eyelets is eliminated.

Figure 1A:
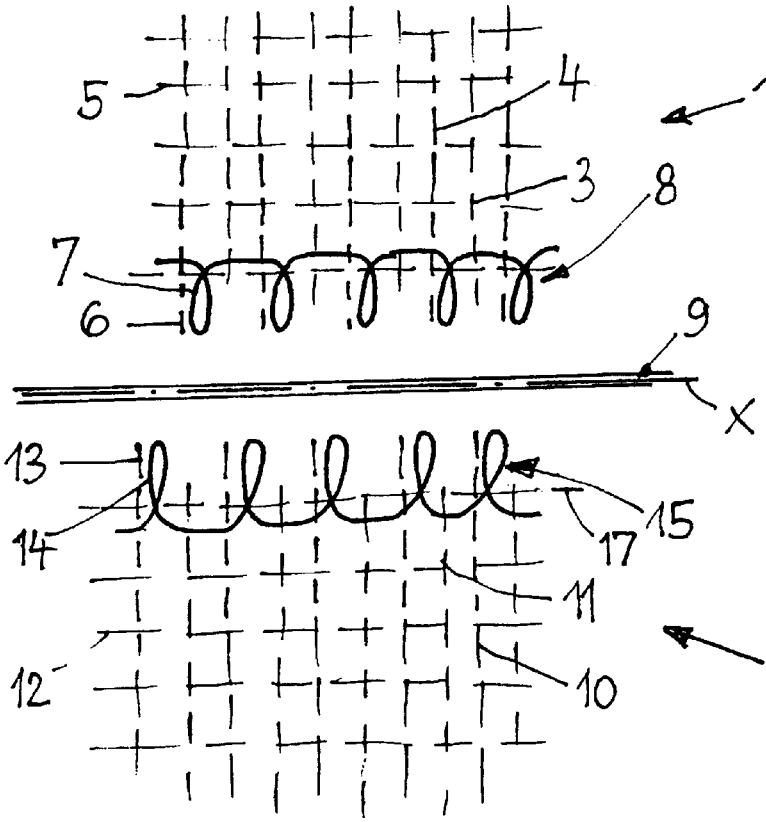
Figure 4:
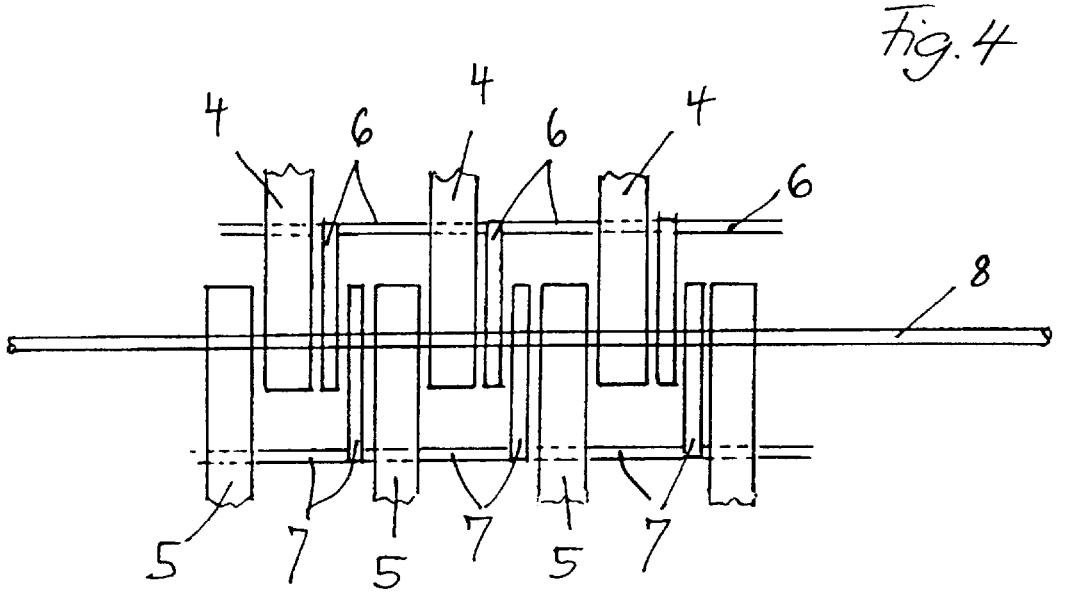
Figure 5:
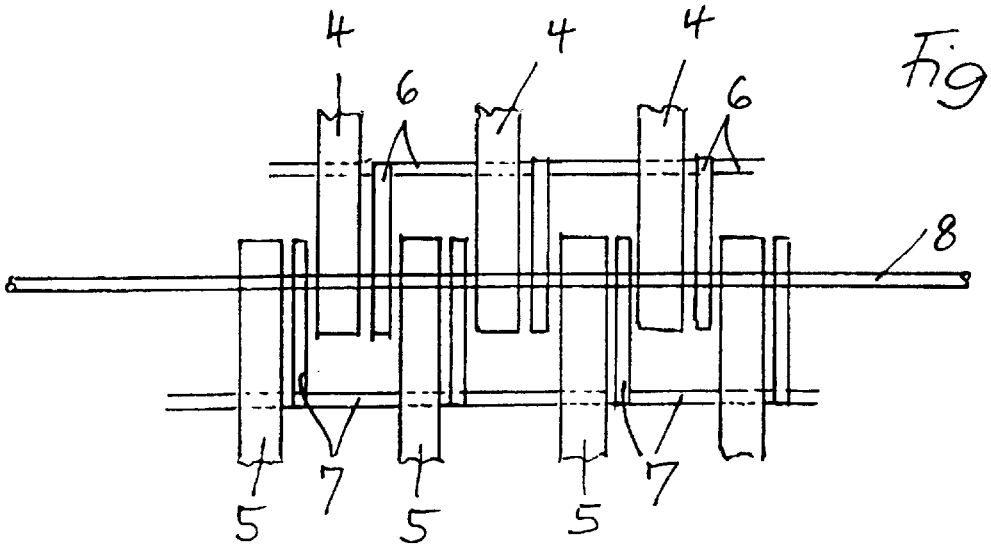
Figure 6:
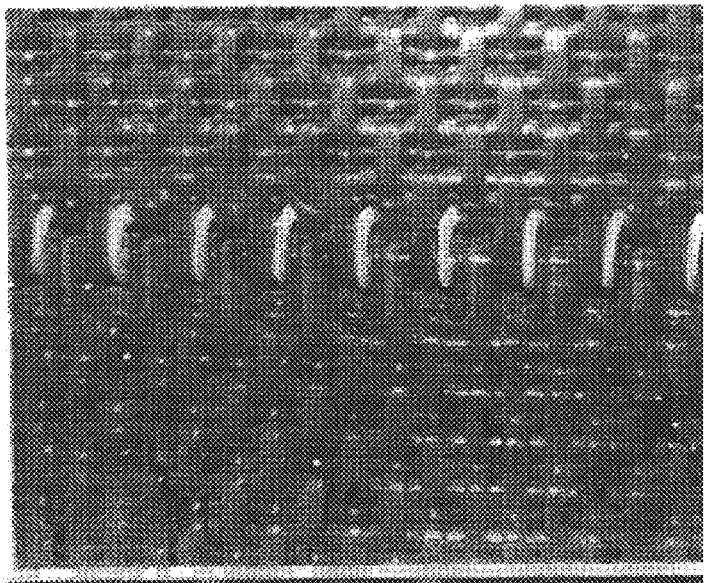
Figure 7:
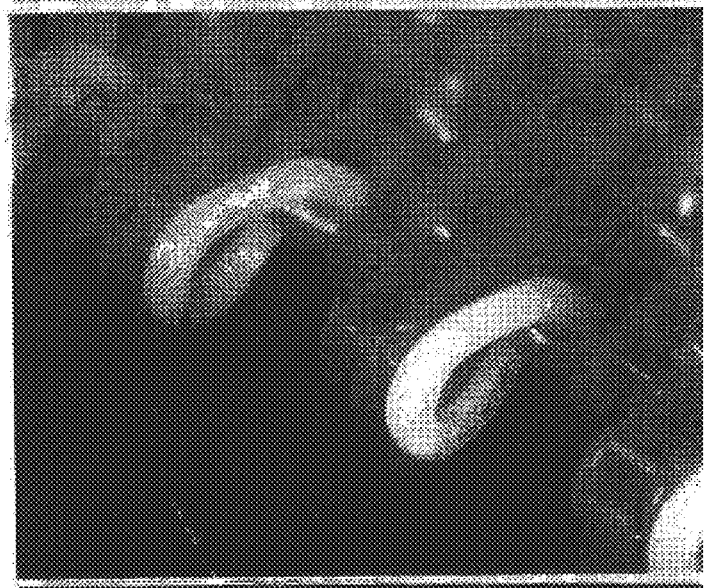
Figure 8:
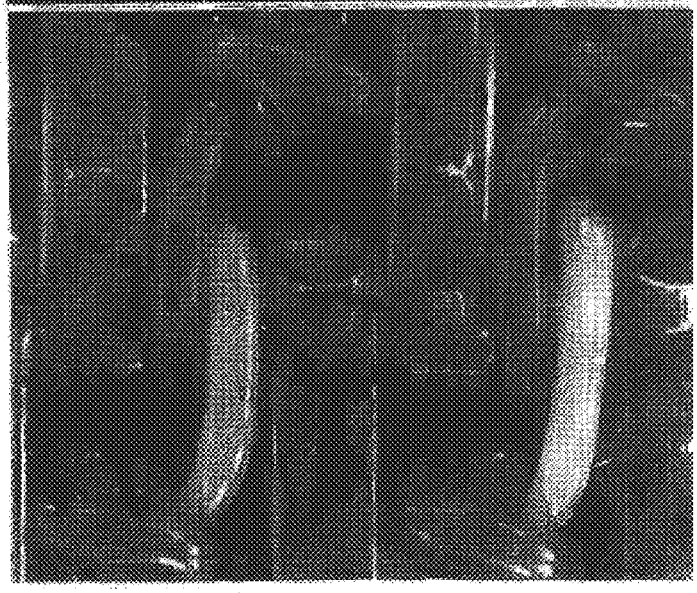

In what follows, the invention is described in conjunction with the drawing by means of an illustrative embodiment. There is shown in:

FIG. 1 a diagrammatic illustration of the principle for two interconnected fabric sections, FIG. 1*a* a diagrammatic representation of the principle corresponding to FIG. 1 with the two fabric sections shown separated from each other, FIG. 2 a top view of the two fabric sections in the interconnected state, FIG. 3 a perspective view of a fabric end with reinforcing yarn for a stitched seam according to the invention, FIG. 4 a diagrammatic representation of an embodiment of the reinforced stitched seam according to the invention, FIG. 5 a further embodiment of a reinforced stitched seam according to the invention similar to the illustration of FIG. 4, FIGS. 6, 7, 8 photographic reproductions of the embodiments of FIG. 1, 2 and 3.

The fabric consists of two fabric sections 1 and 2 whose confronting ends are firmly connected to each other. The warp yarns 3, 4 of the fabric section form loops at their ends. Each second warp yarn 3 is longer at its end than the other half of the warp yarns 4, so that the terminating line in the direction of the weft yarns 5 has a meander-like shape. Each of the protruding warp yarn loops 6 is provided with a turn 7 of a helix 8, so that warp yarn loops 6 and turns 7 are located next to each other in the transverse direction and define a common transverse axis X, along which a connecting wire 9 is led through the loops 6 and turns 7.

The fabric section 2, which is to be connected to the fabric section 1, consists of the warp yarns 10, 11 and the weft yarns 12, with the warp yarns 10 in section 2 being again made longer than the warp yarns 11, with the terminating line again extending in meander-like shape, but laterally displaced by a space, so that the warp yarns 3 of section 1 of the fabric strip and the warp yarns 10 of section 2, as well as the warp yarns 4 and the warp yarns 11 extend in a single line in the lengthwise surface of the fabric strip. Each of warp yarn loops 13 is provided with a turn 14 so that warp yarn loops and turns are located adjacent to each other in the transverse direction and define a common transverse axis.

The helix 8 engaging the warp yarns of fabric section 1 and the helix 15 engaging the warp yarns of fabric section 2 are located coaxially next to each other and engage the connecting wire 9 jointly on their X axis. In so doing, the helix 8 encircles the one or more warp yarns of section 1 which are closest to the axis 9 and the helix 15 the one or more warp yarns of section 2 which are closest to the X axis.

Preferably, the helix 15 also encircles that weft yarn 17 which is closest to the end of the fabric section. However, optionally, additional weft yarns adjoining and paralleling the weft yarn 17, i.e. the second, third or fourth weft yarn from the end can be encircled, i.e. enclosed by the connecting wire in order to reinforce the anchoring of the helix.

LIST OF REFERENCE NUMERALS

1 . . . first fabric section
2 . . . second fabric section
3, 4 . . . warp yarns
5 . . . weft yarns
6 . . . warp yarn loops
7 . . . warp yarn loop turns
8 . . . helix
9 . . . transverse axis
10, 11 . . . warp yarns
12 . . . weft yarns
13 . . . warp yarn loops
14 . . . warp yarn loop turns
15 . . . helix
16 . . . connecting wire
17 . . . weft yarn at the end of the fabric section

What is claimed is:

1. A stitched seam for high-tensile woven fabric sections in which the warp yarn loops at the end of the two fabric sections which are to be connected to each other are connected at their common connecting line by means of a closure wire, characterized in that the warp yarn loops at the stitched connecting location and the closure wire are provided with at least one reinforcing yarn which has loops in the eyelet region paralleling the warp yarn loops for receiving the closure wire.

2. Stitched seam according to claim 1, characterized in that the reinforcing yarns are firmly connected to the warp yarns.

3. Stitched seam according to claim 1, characterized in that the individual reinforcing yarn is led helically around the closure wire and around at least one of the weft yarns adjoining the closure wire along the entire seam.

4. Stitched seam according to claim 1 characterized in that the two confronting sides of the fabric sections are provided with reinforcing yarns jointly surrounding the closure wire.

5. Stitched seam according to claim 1, characterized in that in the axial direction of the closure wire there is located one warp yarn loop and one reinforcing yarn from the one fabric section and one reinforcing yarn and one warp yarn loop from the other fabric section, each surrounding the closure wire.

6. Stitched seam according to claim 3, characterized in that the helical reinforcing yarn is also loosely bound into the eyelet.

7. Stitched seam according to claim 1, characterized in that the reinforcing yarns are monofilament or multifilament yarns of round or flat shape and consist of polyester, PEEK, Ryton, polyamide, PCTA or metal.

8. Stitched seams according to claim 1, characterized in that the reinforcing yarns have inserts of thin steel wire.

9. Stitched seam according to claim 1, characterized in that the reinforcing yarns substantially fill the space between the eyelets of the warp loops.

10. Stitched seam according to claim 1, characterized in that the reinforcing yarns are mono- or multi plastics with various core yarns.

11. Stitched seam according to claim 1 wherein the woven fabric sections are sections of a papermaker's dryer fabric.

* * * * *